US008800802B2

(12) United States Patent
Martin

(10) Patent No.: US 8,800,802 B2
(45) Date of Patent: Aug. 12, 2014

(54) STACKABLE CONTAINER WITH SELECTABLE PARTITIONS

(71) Applicant: Scott Martin, Germantown, TN (US)

(72) Inventor: Scott Martin, Germantown, TN (US)

( * ) Notice: Subject to any disclaimer, the term of this patent is extended or adjusted under 35 U.S.C. 154(b) by 0 days.

(21) Appl. No.: 13/707,056

(22) Filed: Dec. 6, 2012

(65) Prior Publication Data

US 2014/0158694 A1 Jun. 12, 2014

(51) Int. Cl.
*B65D 25/04* (2006.01)
*A47G 19/03* (2006.01)

(52) U.S. Cl.
CPC ..... *A47G 19/03* (2013.01)
USPC ..... 220/529; 220/530; 220/531; 220/557; 220/575

(58) Field of Classification Search
CPC ..... B65D 25/04; B65D 25/06; B65D 1/265
USPC ..... 220/503, 504, 528, 529, 530, 531, 552, 220/557, 575
See application file for complete search history.

(56) References Cited

U.S. PATENT DOCUMENTS

| | | | | |
|---|---|---|---|---|
| 1,038,644 | A * | 9/1912 | Phin | 206/459.5 |
| 1,912,505 | A | 6/1933 | Weston | |
| 2,220,190 | A | 11/1940 | Wolf | |
| 3,400,855 | A * | 9/1968 | Alexander | 220/719 |
| 3,731,870 | A | 5/1973 | Buttery | |
| 3,735,916 | A | 5/1973 | Buttery | |
| 5,198,127 | A | 3/1993 | Tilley et al. | |
| 5,588,583 | A | 12/1996 | Cargile, Jr. | |
| 5,657,925 | A | 8/1997 | Norris | |
| 5,934,501 | A | 8/1999 | Wright et al. | |
| 6,213,335 | B1 | 4/2001 | Wilson | |
| 8,474,641 | B2 * | 7/2013 | Hays et al. | 220/23.89 |
| 2011/0290796 | A1 * | 12/2011 | Burgess | 220/23.2 |

* cited by examiner

*Primary Examiner* — Fenn Mathew
*Assistant Examiner* — Madison L Poos
(74) *Attorney, Agent, or Firm* — William S. Parks; Wyatt, Tarrant & Combs, LLP

(57) ABSTRACT

A stackable container and cup, having one or more selectable attached divider or dividers, the divider or dividers allowing the container to hold a single substance, or multiple distinct substances, such as ice cream, without the unwanted mixing of the substances.

16 Claims, 21 Drawing Sheets

STACKABLE CONTAINER WITH SELECTABLE PARTITIONS

BACKGROUND OF THE INVENTION

The present invention relates to stackable containers having attached partitions for separating and minimizing intermixing of contents. Traditional stacking containers, suitable for holding semi-liquid contents such as ice-cream, frozen yogurt or the like, generally lack the ability to partition multiple flavors into individual compartments. Should a person order two flavors from an ice cream shop, the flavors, and toppings are generally placed together, or on top of one another, preventing the user from fully enjoying the distinct flavors of each. The addition of a loose partition is undesirable because it may move or shift when the contents are inserted into the container, or when the user is removing them for consumption. Repositioning of a loose partition takes time, and creates a cumbersome additional obstacle for the efficient serving of frozen treats, in addition to allowing the intermingling of the contents. Containers with built-in partitions do not allow for selectable deployment of the partitions, which creates a need to store multiple types of containers, or may not allow the efficient stacking of such containers. Customer expectations regarding the container size and shape also influence the design criteria, specifically; a consumer generally would expect a frustro-conically shaped container, which prohibits the use of traditional flat and wide take-out style containers generally used for meals. What is needed is a container having one or more dividers attached to the interior wall of the container allowing easy deployment and use, while allowing the server to place the desired number of distinct contents within the container, or selectively use no divider at all.

BRIEF SUMMARY OF THE INVENTION

The present invention allows a user to separate the contents of a container by positioning divider partitions attached to the inside of the container. The partitions may be folded along the interior surface of the container to allow stacking of the containers for efficient and compact storage. Multiple dividers may be attached to a single primary divider, allowing the primary divider to be the only divider attached to the container wall, simplifying assembly.

To use the invention, the operator, or server, simply repositions the divider, or dividers, to the desired position within the container and adds the desired content for each partition. The dividers attachment to the interior wall prevents movement of the divider when filling, or when consuming the contents.

The relative few parts of the invention make it a simple robust design that is easier use and manufacture for reduced cost and complexity when compared to containers having separate removable dividers. The attachment of multiple dividers to a single primary divider allows for modular construction of the container for efficient construction.

BRIEF DESCRIPTION OF THE DRAWINGS

The invention is illustrated by the accompanying drawings, in which.

DETAILED DESCRIPTION OF THE INVENTION

Figure 1:
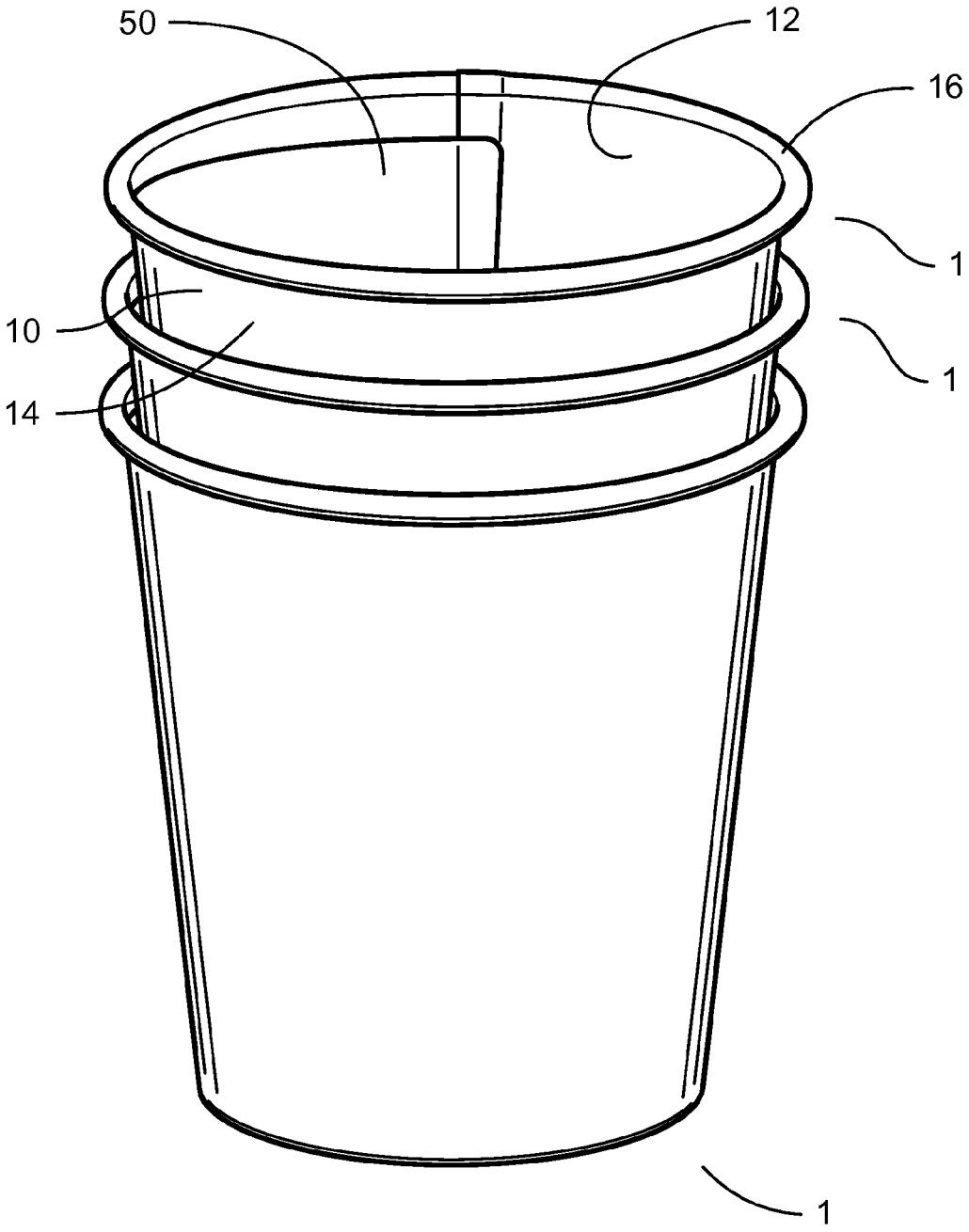
FIG. 1 is a front perspective view of a first embodiment of the invention in a stacked configuration.

FIG. 1 shows a front perspective view of a first embodiment of the invention 1 in a stacked configuration. The invention 1 has a vertical wall 10 forming the sides of the container, shown here as a frustro-conically shaped cup, the vertical wall having an inner surface 12 and an outer surface 14. Here, the top edge 16 of the vertical container wall 10 is a rolled edge. The invention 1 has a user selectable divider 50 attached to the vertical wall 10 inner surface 12.

Figure 2:
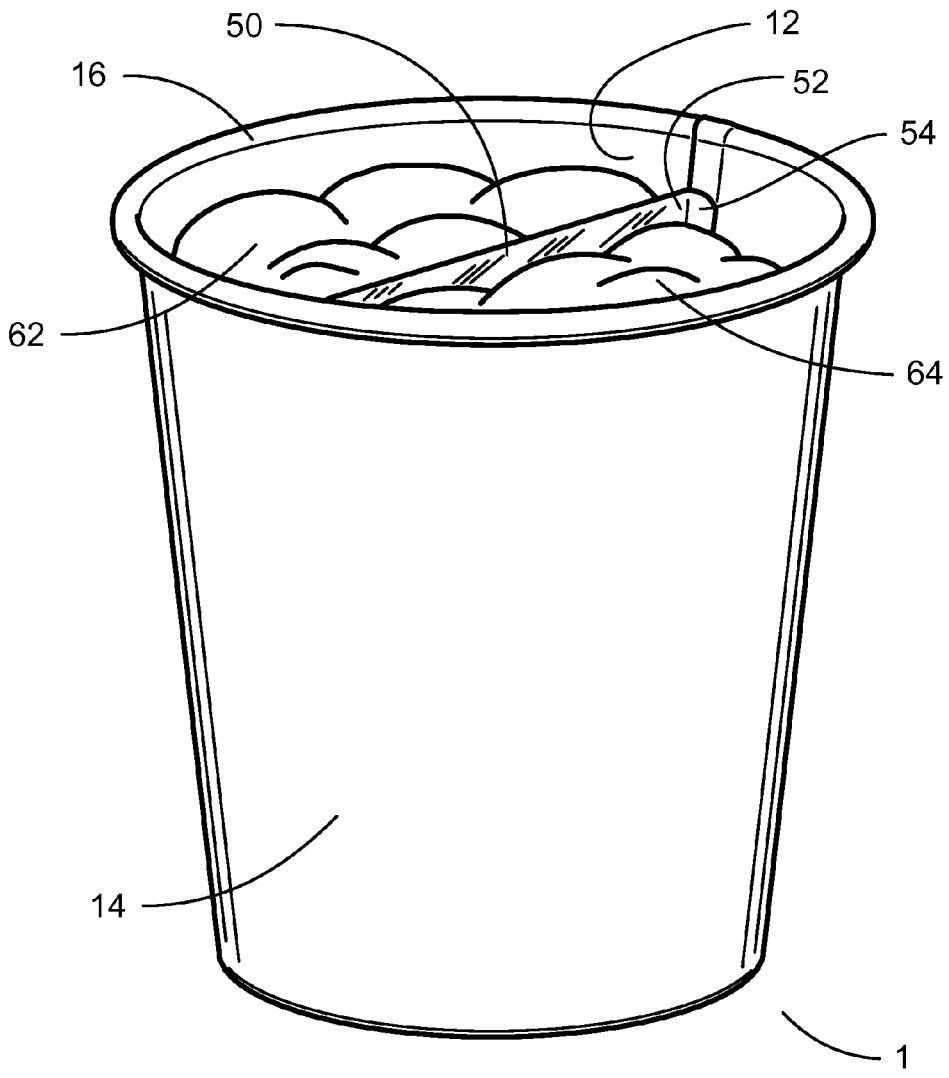
FIG. 2 is a front right perspective view of the first embodiment of the invention with a single selectable divider separating two substances.

FIG. 2 shows the first embodiment of the invention 1 having a single vertical divider 50 separating the contents of the container, or cup, in two parts 62, 64. The first part 62 can be a different substance than the second part 64, thus the divider serves to resist the intermingling of the contents 62, 64 and the contents' textures and flavors preserving each substance's properties for a later time, such as the moment of consumption. Here the divider 50, is attached to the inner surface 12 of the container by a tab 54. A bend 52, which may be creased, bent, perforated, or otherwise manipulated to form a live hinge, allows the folding of the divider 50 into a deployed position as shown.

Figure 3:
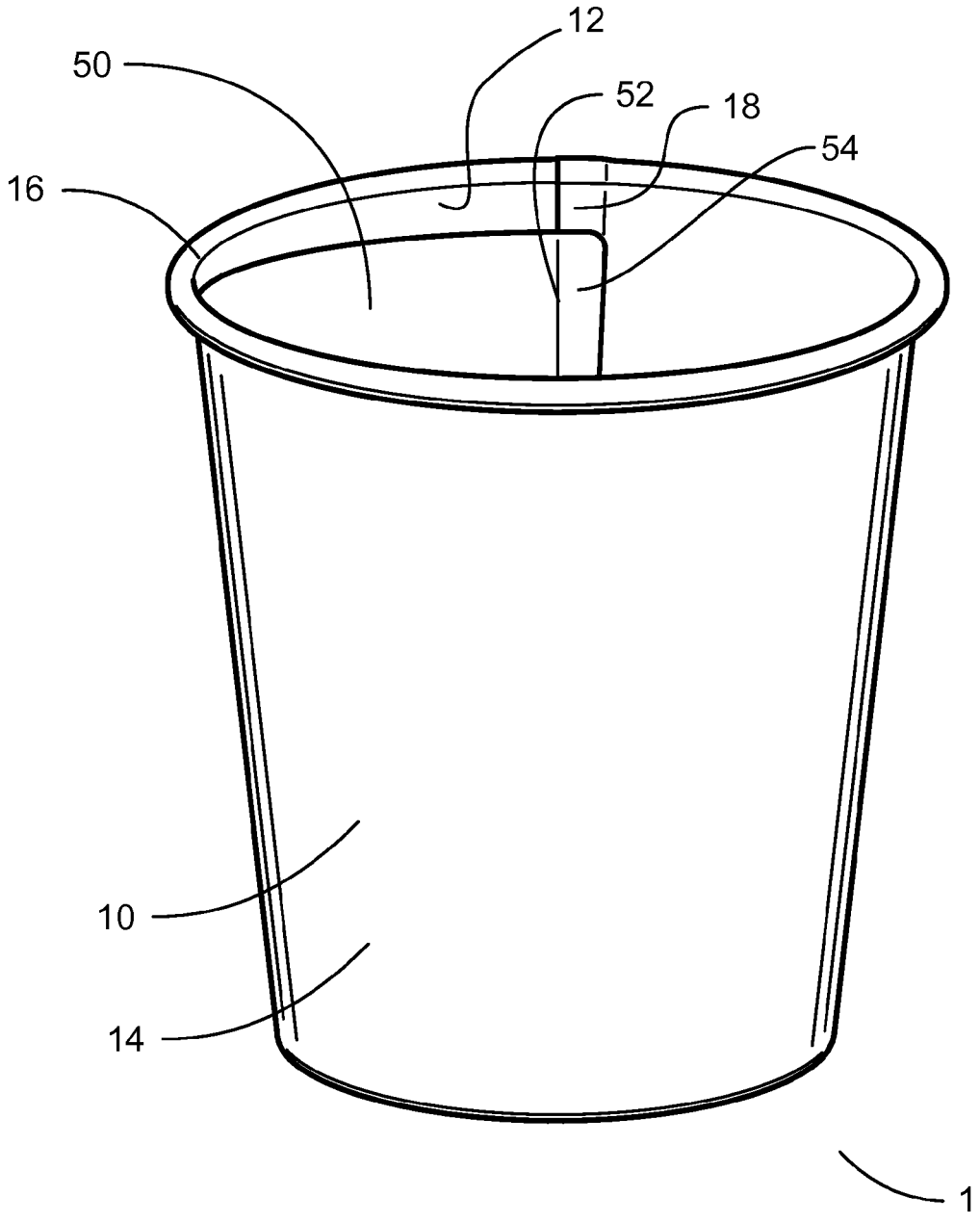
FIG. 3 is a front perspective view of the invention with the selectable divider lying against the inner surface of the wall of the container.

FIG. 3 shows the first embodiment of the invention 1 having a single vertical divider 50 folded against the inner surface 12 of the vertical wall 10 of the container. The divider 50 attaches along one edge of the divider allowing the divider to lie against the inner surface 12. The attachment may occur at any location along the inner surface 12, however, in the preferred embodiment the attachment occurs along the vertical wall 10 seam 18 simplifying the construction.

Figure 4:
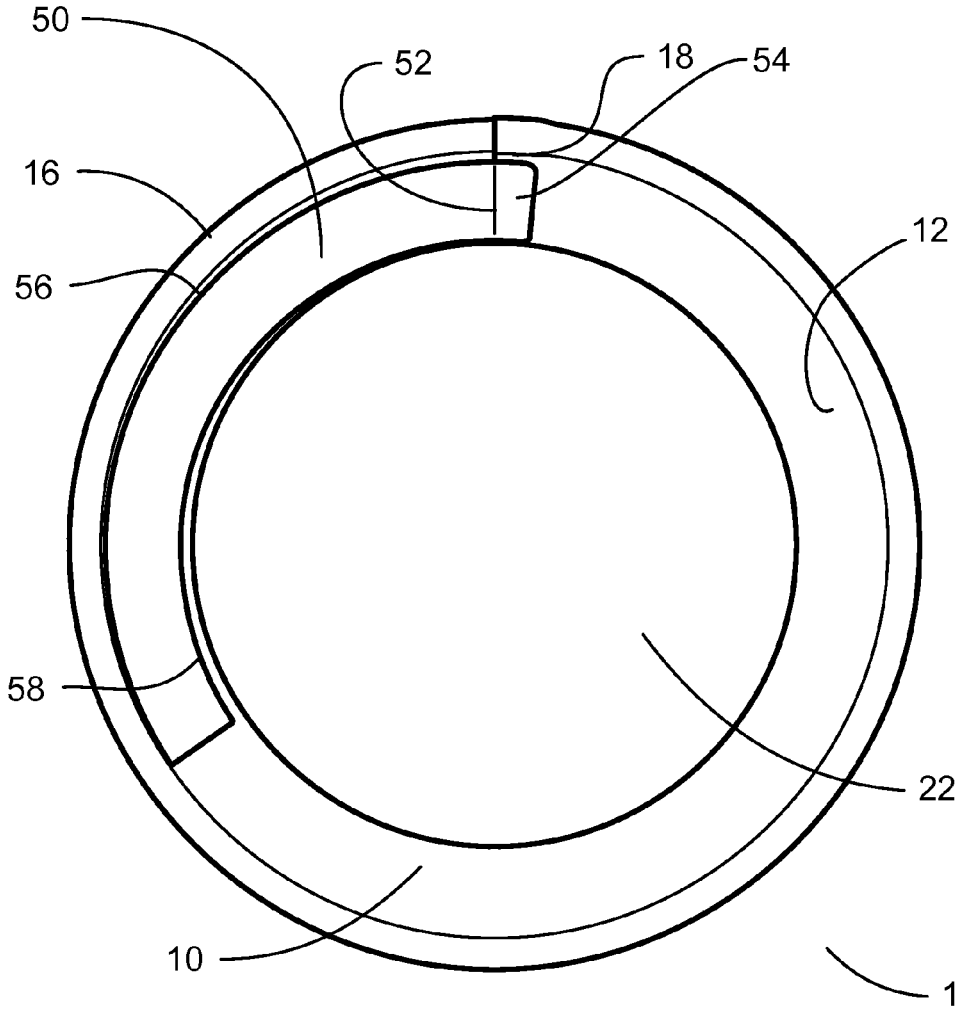
FIG. 4 is a top view of the first embodiment of the invention.

FIG. 4 shows a top view of the first embodiment of the invention 1. The divider 50 extends from the top edge 16 of the wall 10 of the container, or cup, to the bottom wall 22 of the container (or cup). In the preferred version of the first embodiment, the divider 50, is slightly longer along the top divider edge 56 than along the bottom divider edge 58 to accommodate the frustro-conical shape of the preferred version of the first embodiment when the divider is deployed as a partition. In the preferred version of the first embodiment, the top divider edge 56 reaches closest to the top edge 16 of the wall 10 closest to the free vertical divider edge 60 and is slightly more distant to the top edge 16 of the wall 10 at the seam 18 when lying along the inner surface 12 of the wall 10. The inclination of the divider 50 in the stowed position allows the divider 50 top edge 16 to span horizontally across the container when deployed as a partition.

Figure 5:
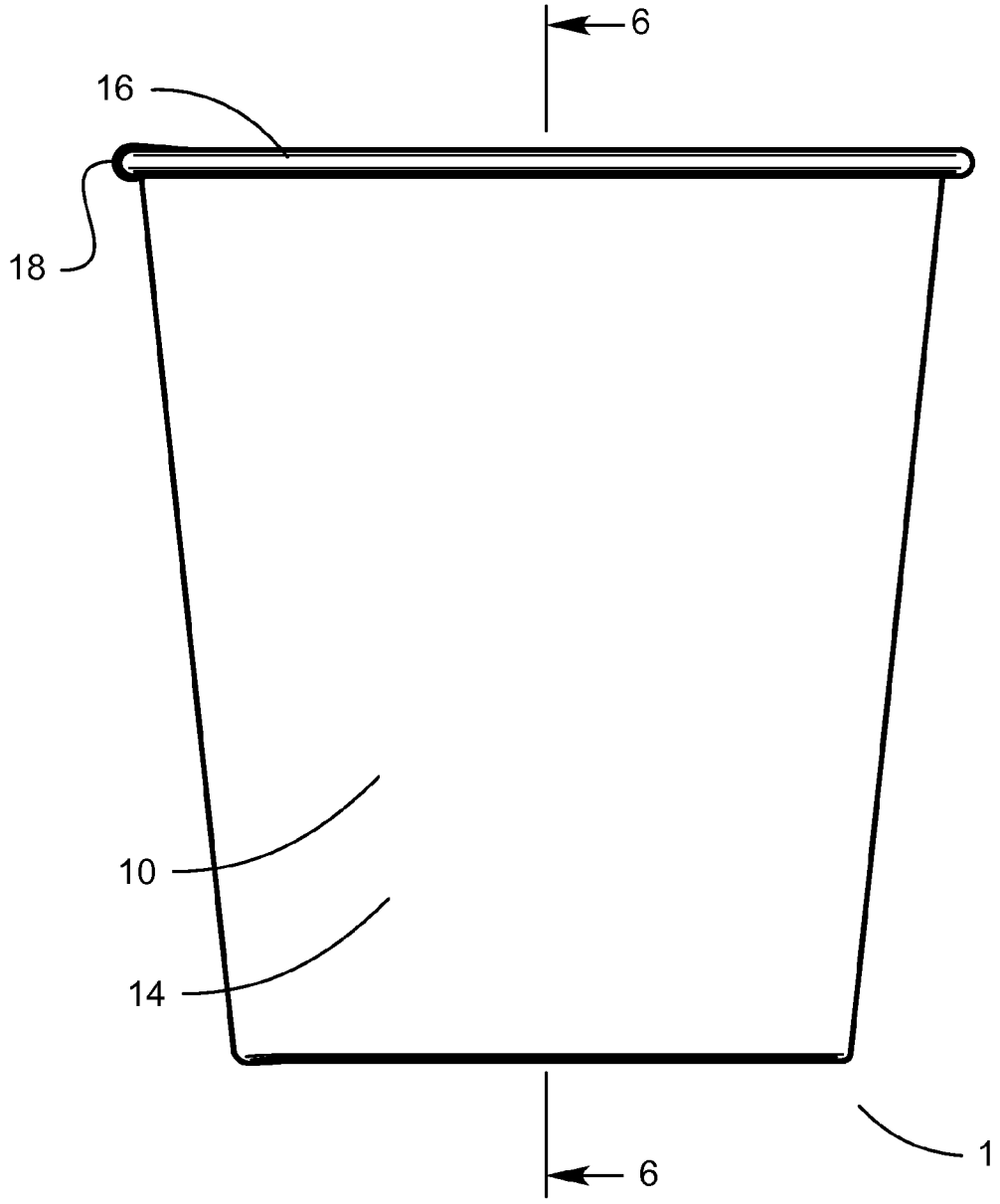
FIG. 5 is a left side view of the first embodiment of the invention.

FIG. 5 shows a left side view of the first embodiment of the invention 1. Here, the rolled top edge 16 can be seen. The seam 18 of the wall 10 of the container is positioned to the left.

Figure 6:
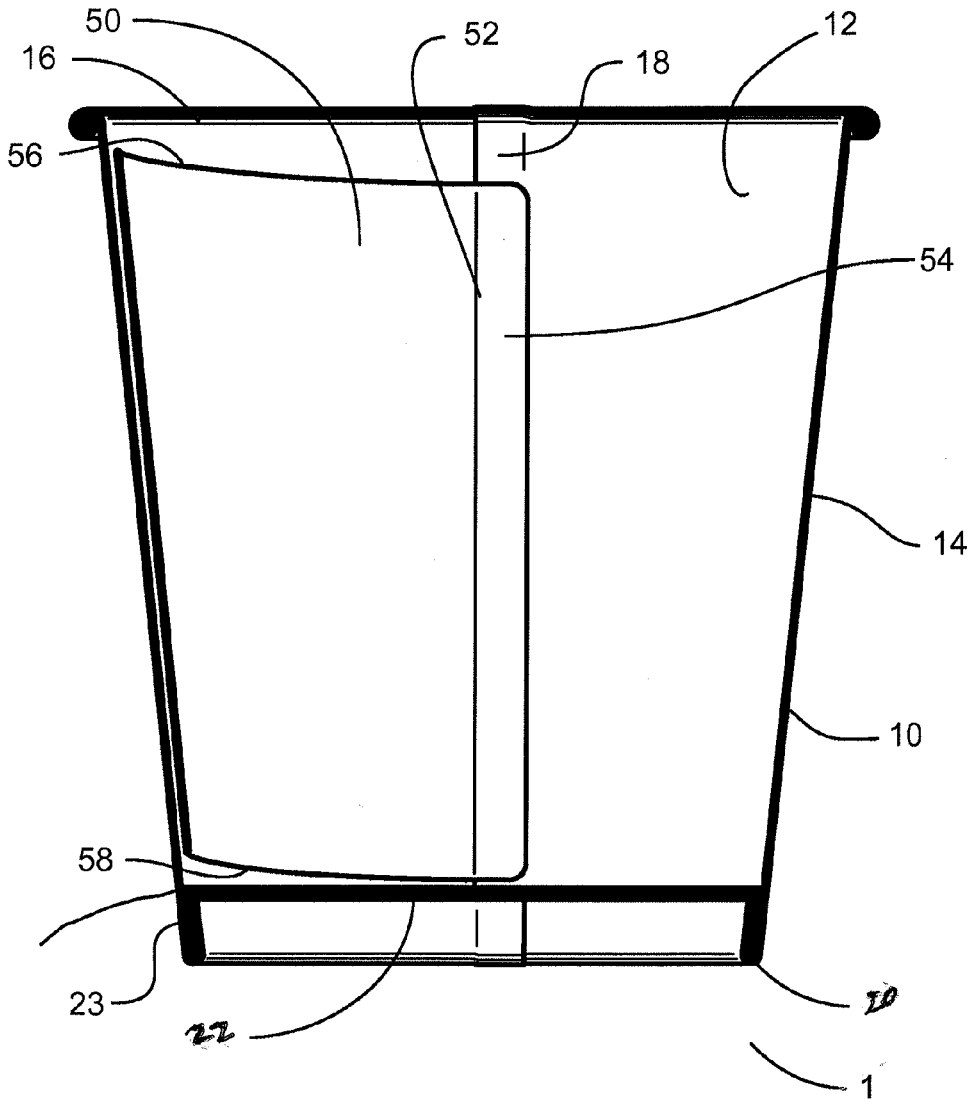
FIG. 6 is a cross-section view of the first embodiment of the invention taken on line 6-6 in FIG. 5.

FIG. 6 shows a cross-section view of the first embodiment of the invention taken on line 6-6 in FIG. 5. The vertical wall 10 of the invention is terminated at the top by a rolled edge 16 and terminated at the bottom by folding and bonding to the bottom wall 22 at the bottom edge 20 at the vertical portion 23 of the bottom wall. Part of the divider 50 can be seen attached at the seam 18 of the container 1.

Figure 7:
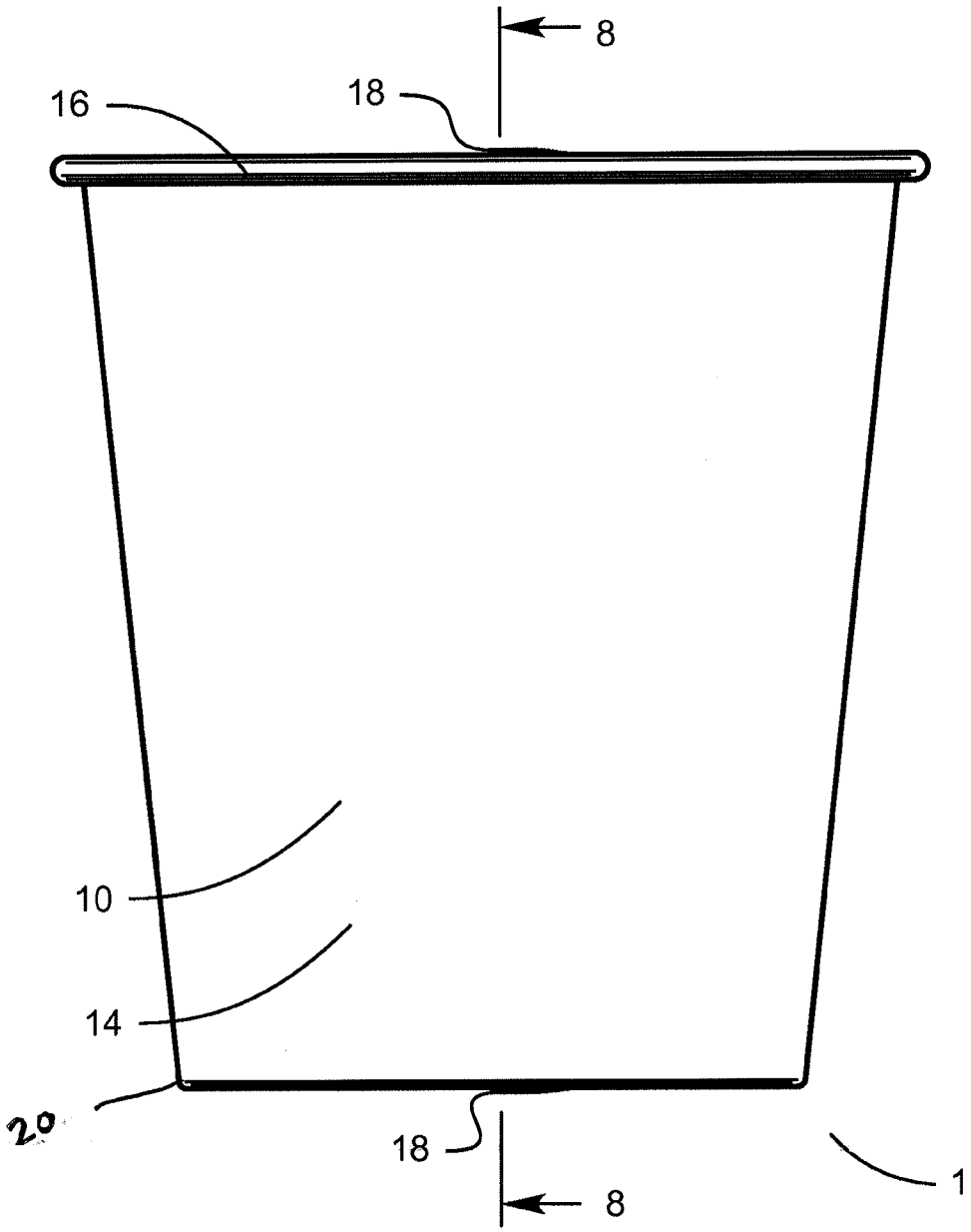
FIG. 7 is a front view of the first embodiment of the invention.

FIG. 7 shows a front view of the first embodiment of the invention showing the outer wall 14, rolled top edge 16, bottom edge 22, and a small portion of the seam 18 of the container 1.

Figure 8:
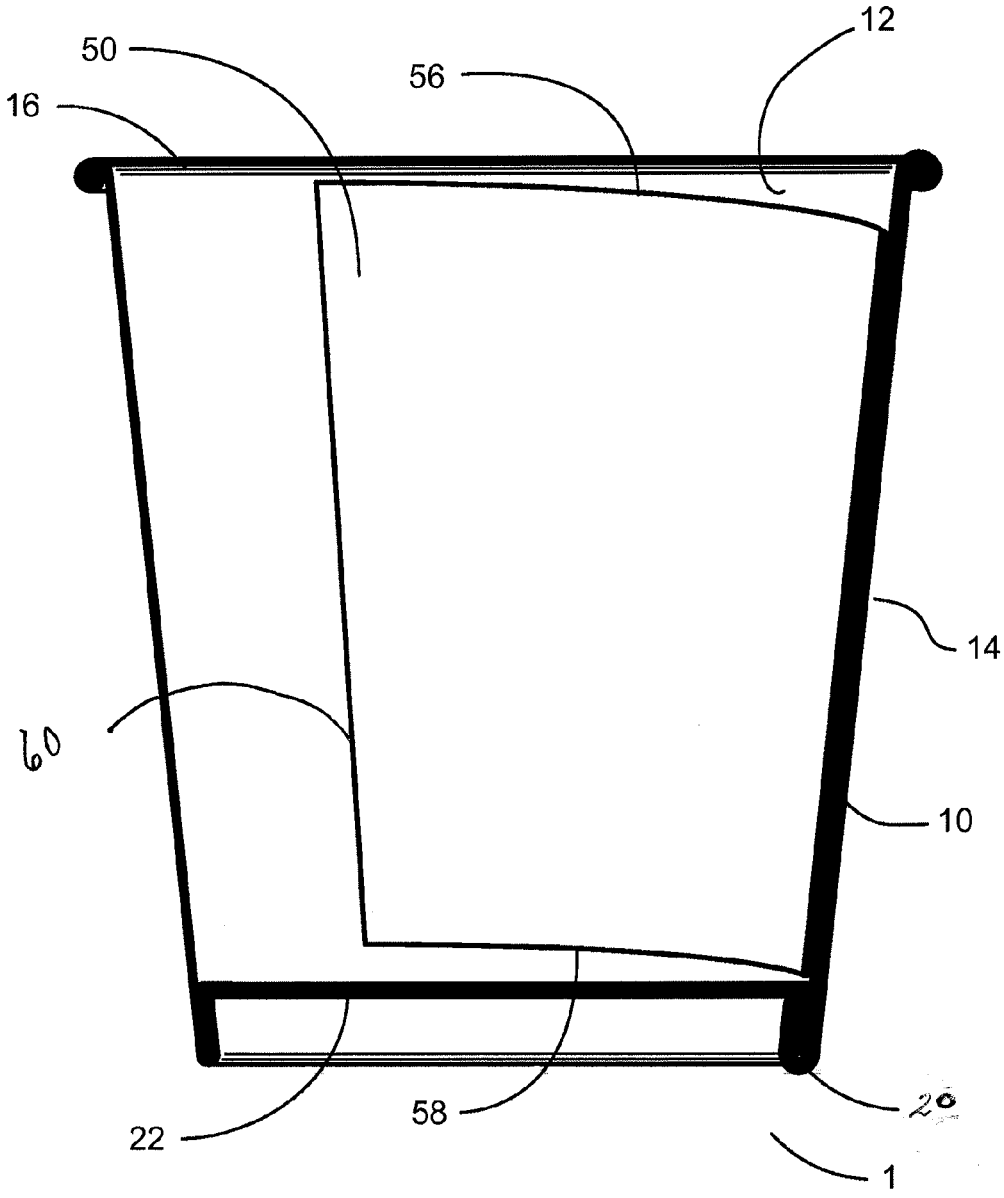
FIG. 8 is a cross section view of the first embodiment of the invention taken on line 8-8 in FIG. 7.

FIG. 8 shows a cross-section view of the first embodiment of the invention taken on line 8-8 in FIG. 7. The free edge 60 of the divider 50 is shown resting against the inside surface 12 of the wall 10 of the container 1. The top edge 56 of the divider 50 rests below the top edge 16 of the container 1.

Figure 9:
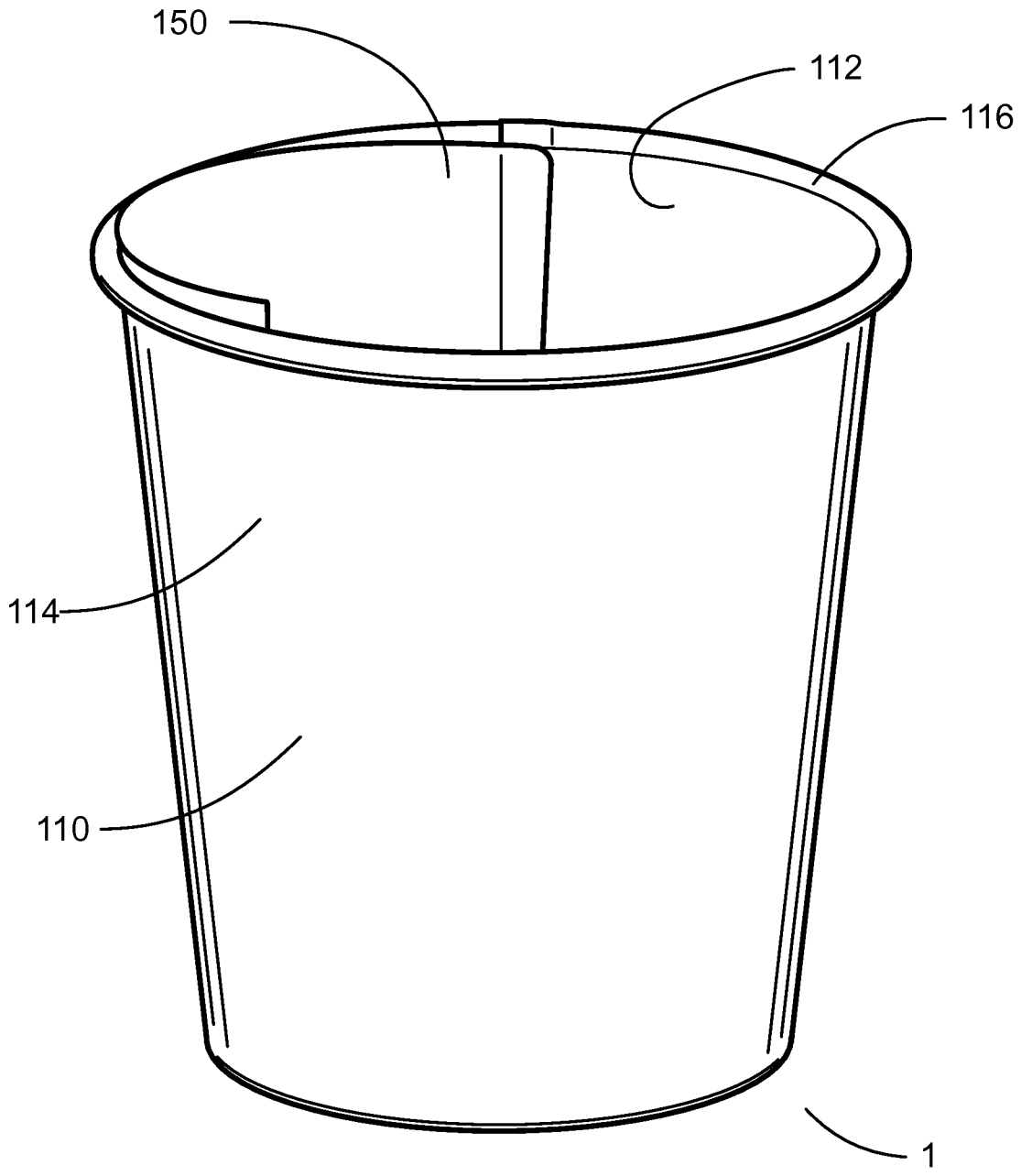
FIG. 9 is a front perspective view of a second embodiment of the invention having the selectable divider rising slightly above the container when folded along the inner surface of the container wall.

FIG. 9 is a front perspective view of a second embodiment of the invention 1 having the selectable divider 150 rising slightly above the container top edge 116 when folded along the inner surface 112 of the container wall 110 (and having an outer surface 114).

Figure 10:
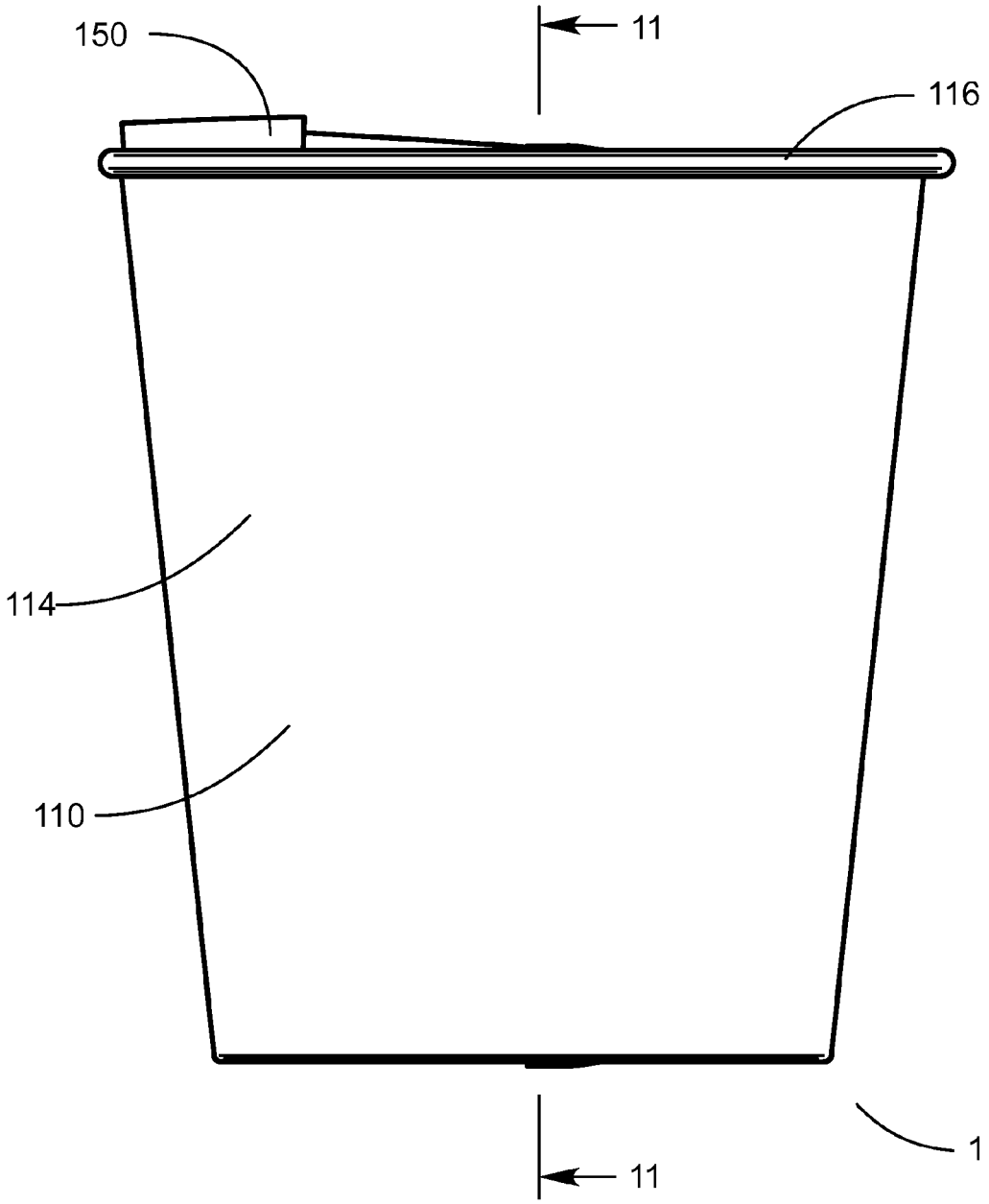
FIG. 10 is a front view of the second embodiment of the invention.

FIG. 10 is a front view of the second embodiment of the invention 1 showing the divider 150 rising above the top edge 116 of the container wall 110.

Figure 11:
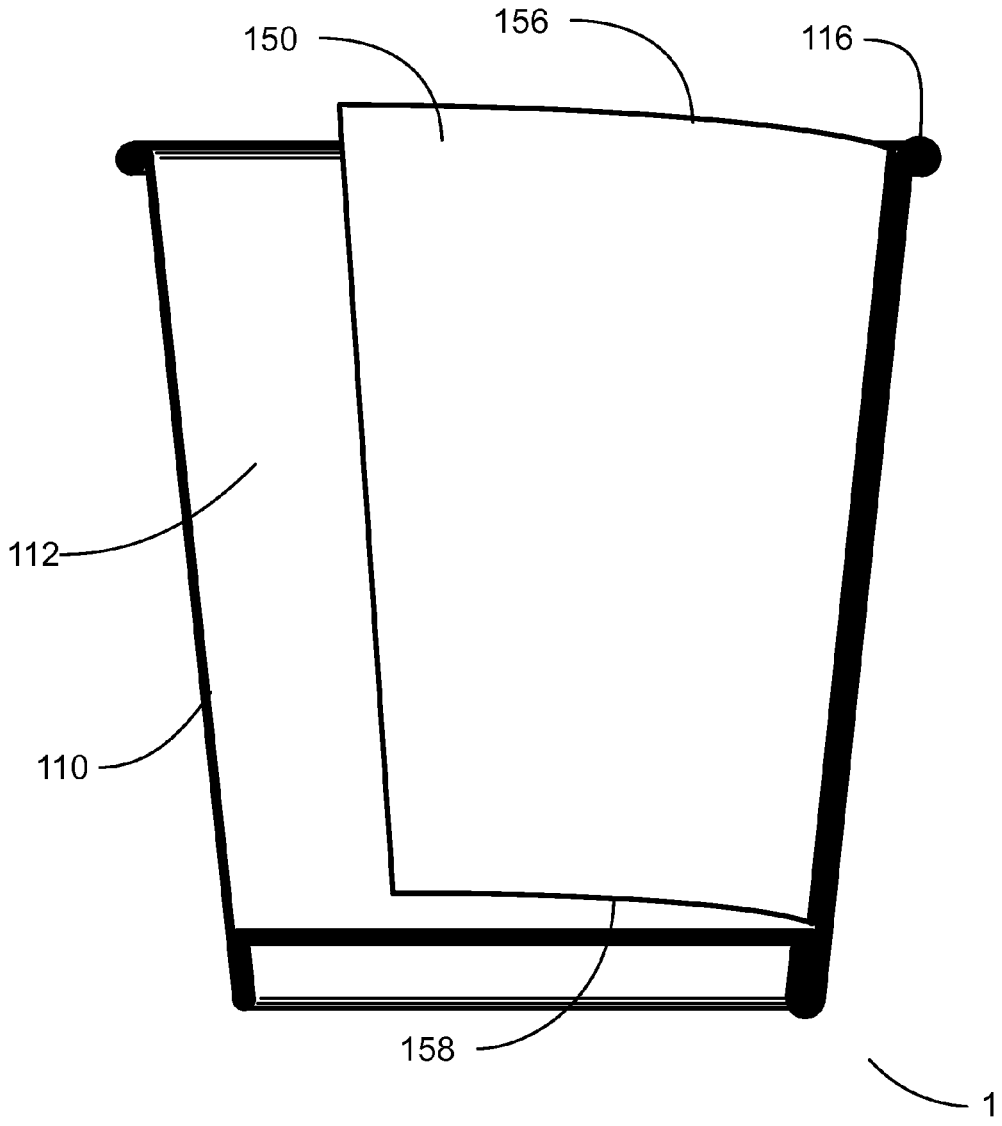
FIG. 11 is a cross section of the second embodiment of the invention taken on line 11-11 in FIG. 10.

FIG. 11 is a cross section of the second embodiment of the invention 1 taken on line 11-11 in FIG. 10. A divider 150 is provided which includes a top edge 156 and a lower edge 158. The top edge 156 of the divider 150 rises above the top edge 116 of the container wall 110 while laying against the inside surface 112 and thus allows the divider 150 to be easily grasped and positioned by the user.

Figure 12:
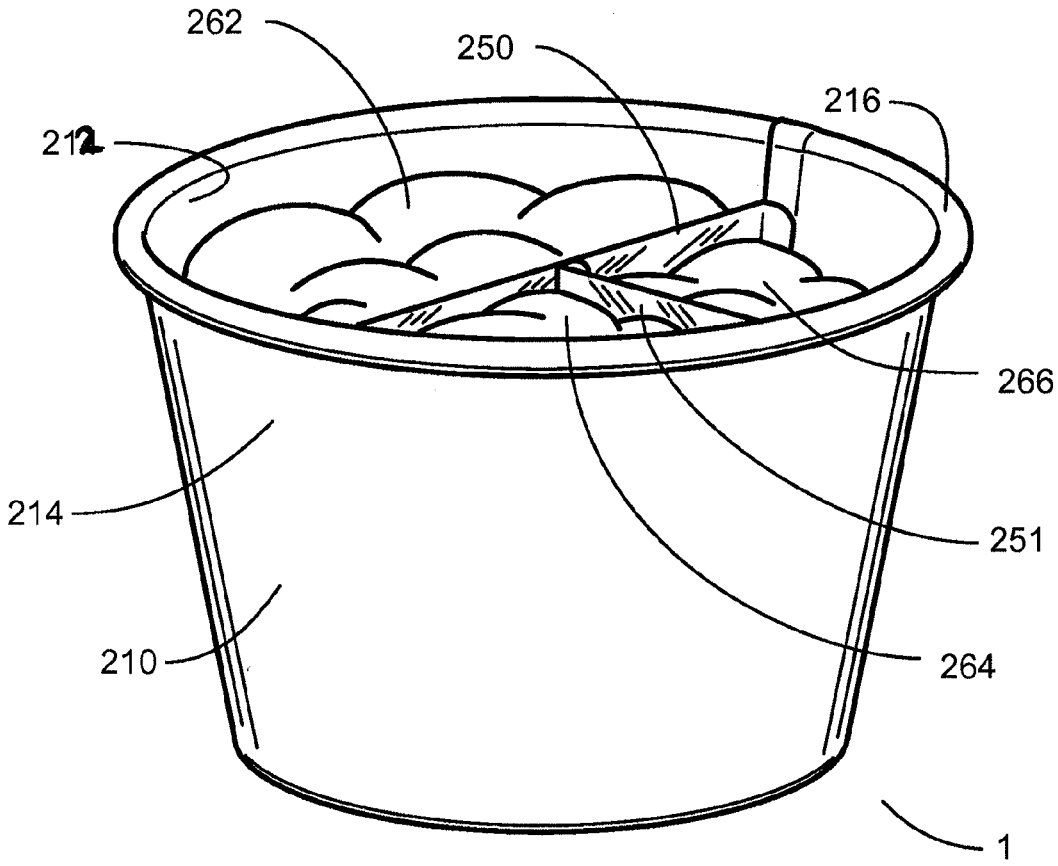
FIG. 12 is a perspective view of a third embodiment of the invention having a second divider attached to the first divider.

FIG. 12 is a perspective view of a third embodiment of the invention 1 having a second divider 251 attached to the first divider 250. Additionally the third embodiment possesses a squat stature, that is, the diameter of the container is larger than the height of the container. The squat stature of the third embodiment lends itself for consumption of semi-solids such as ice cream, frozen custard or frozen yogurt using a spoon. It should be understood that the other embodiments disclosed herein may possess a similar squat stature, and that this embodiment may possess a more elongated stature as shown in the other embodiments. The second divider 251 is attached on one surface of the first divider 250. This allows for modular construction of the invention 1 by enabling attachment of the second divider 251 to the first divider 250 than subsequent attachment of the first divider 250 to the interior surface 212 of the container wall 210 (and having an outer surface 214). The second divider of the third embodiment allows for division of the contents 262, 264, 266 of the container 1 into three distinct portions.

Figure 13:
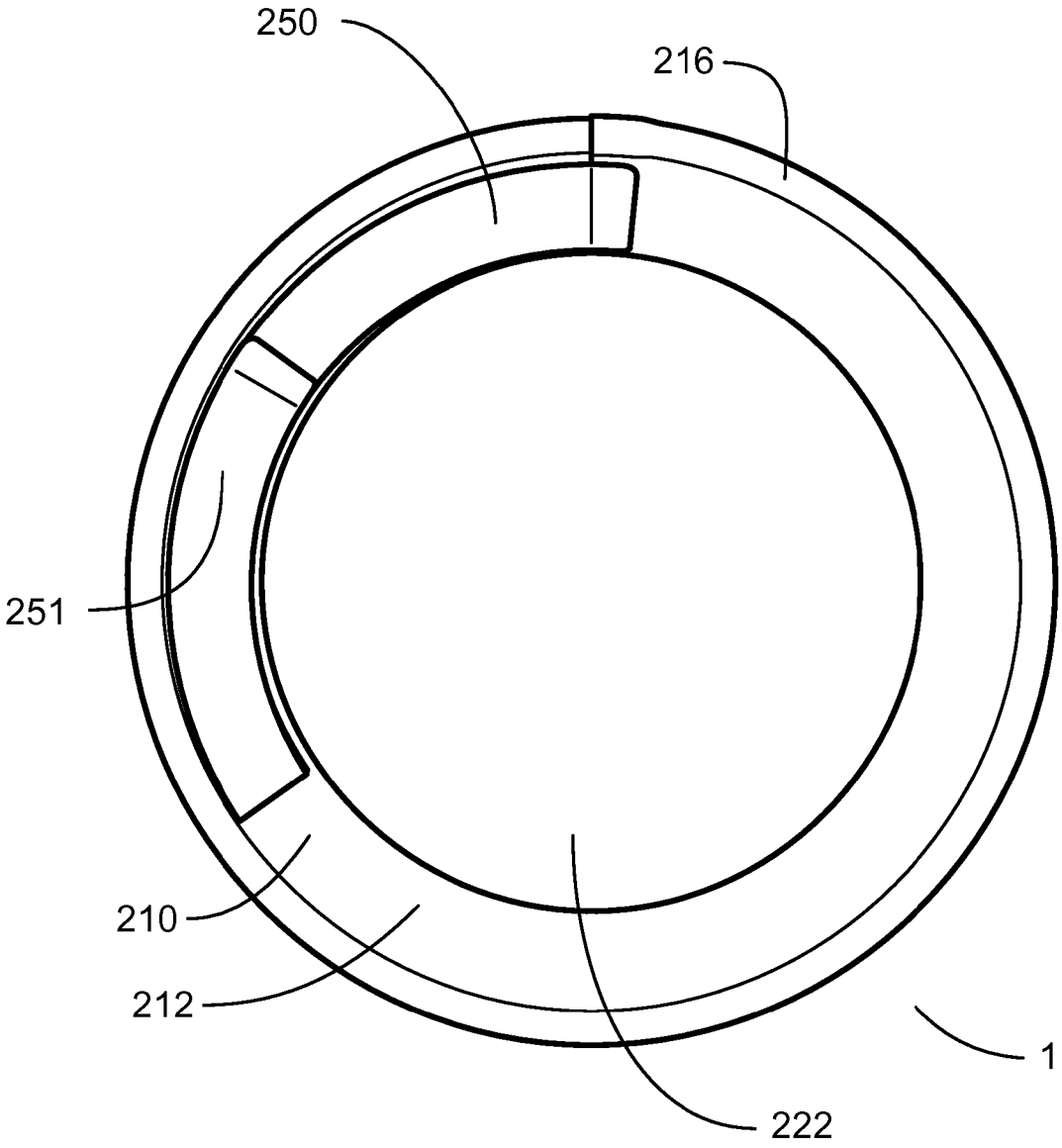
FIG. 13 is a top view of the third embodiment of the invention.

FIG. 13 is a top view of the third embodiment of the invention 1 showing the first divider 250 and second divider 251 folded flat along the interior surface 212 of the container wall 210.

Figure 14:
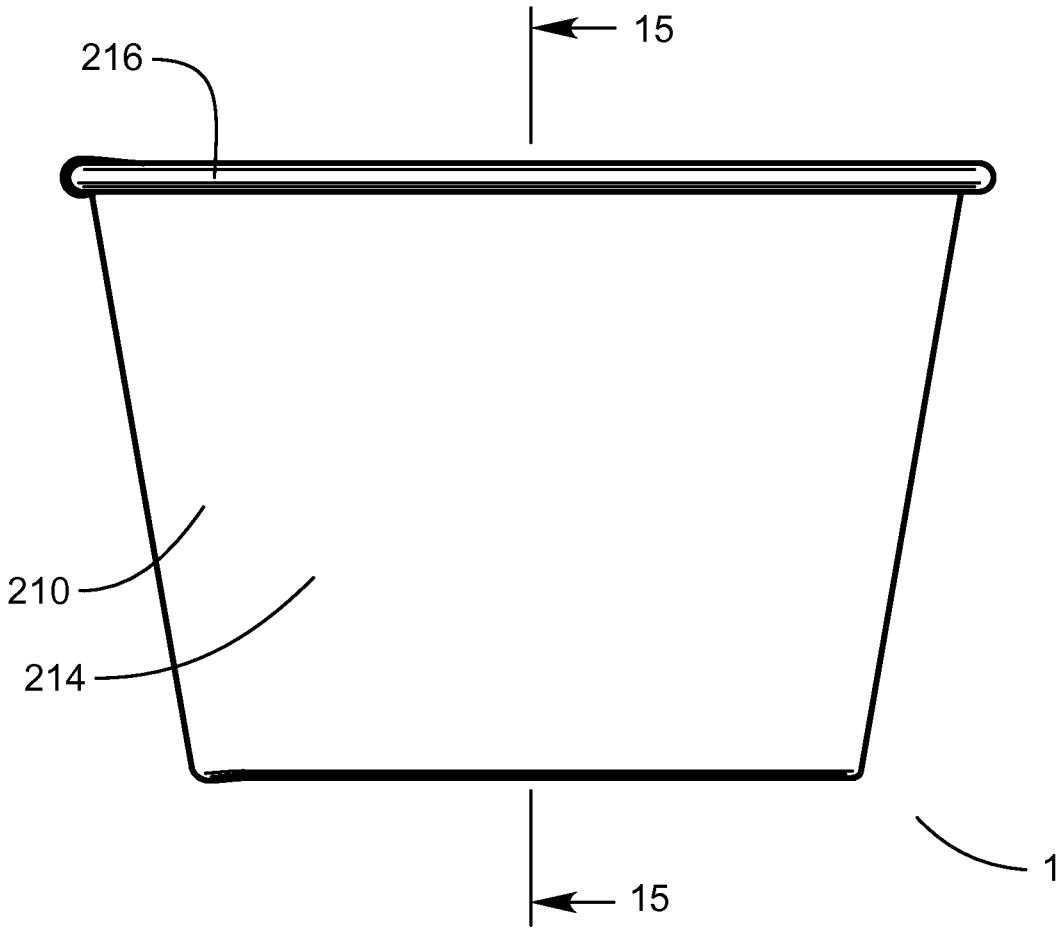
FIG. 14 is a left side view of the third embodiment of the invention.

FIG. 14 is a left side view of the third embodiment of the invention 1.

Figure 15:
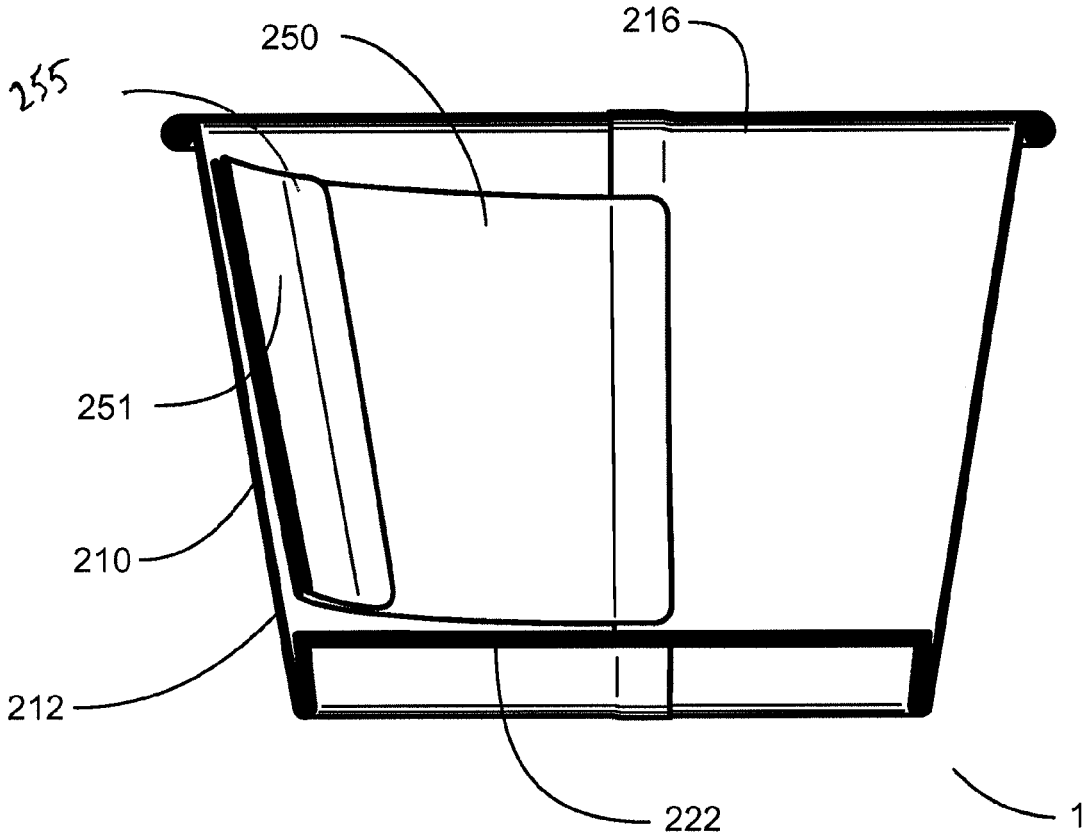
FIG. 15 is a cross-section of the third embodiment of the invention taken on line 15-15 in FIG. 14.

FIG. 15 is a cross-section of the third embodiment of the invention 1 taken on line 15-15 in FIG. 14. In the preferred version of the third embodiment, the second divider 251 is attached by a tab 255 to the first divider 250 and the first divider 250 is attached to the interior wall 212.

Figure 16:
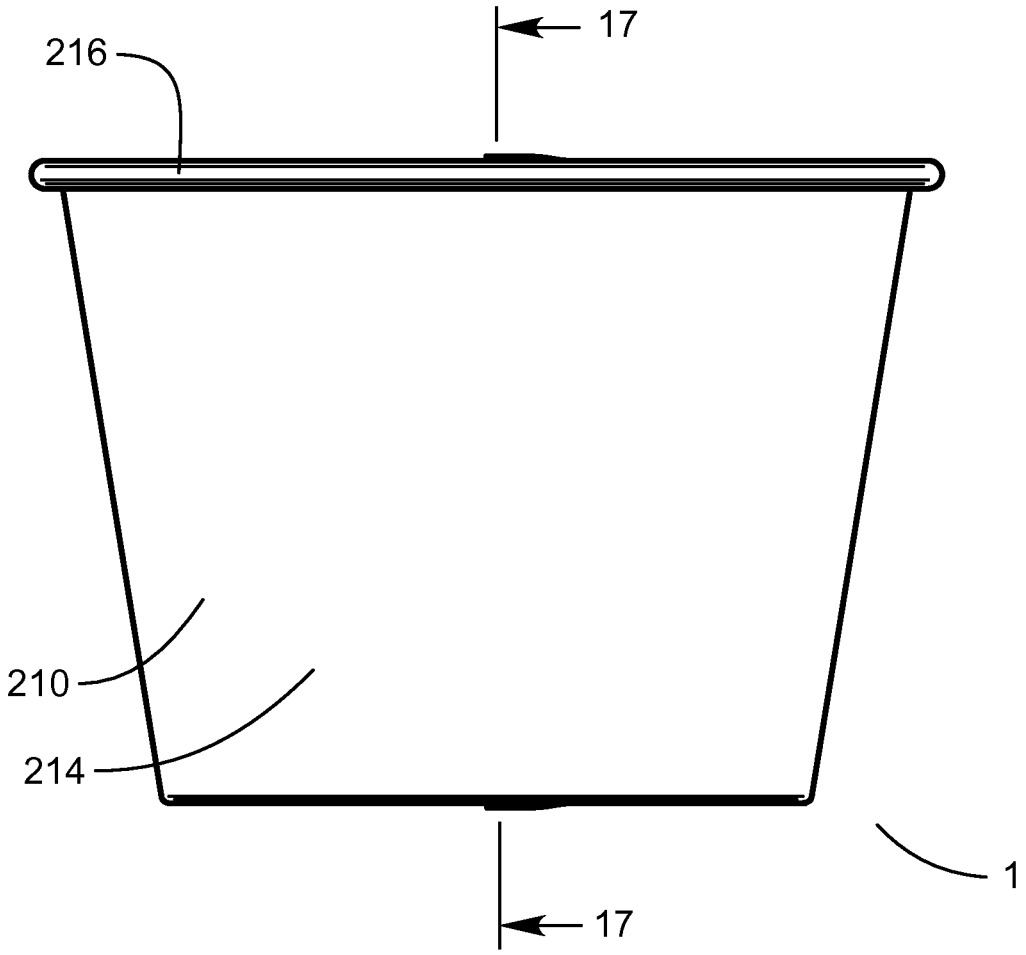
FIG. 16 is a front view of the third embodiment of the invention.

FIG. 16 is a front view of the third embodiment of the invention.

Figure 17:
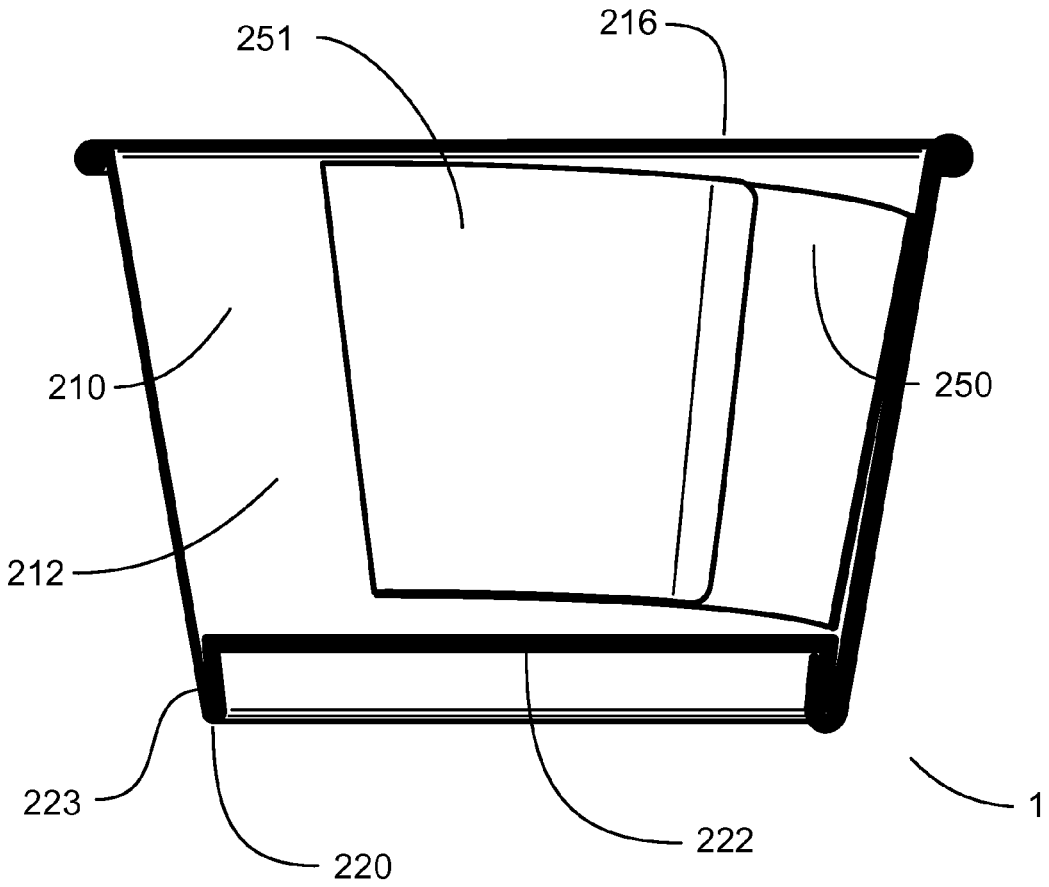
FIG. 17 is a cross-section of the third embodiment of the invention taken on line 17-17 in FIG. 16.

FIG. 17 is a cross-section of the third embodiment of the invention taken on line 17-17 in FIG. 16. While the top edge of the dividers 250, 251 are shown to rest below the top edge 216 of the wall 210 of the container, it should be understood that the dividers 250 or 251 could rest above the top edge 216 of the container, as shown in the second embodiment to aid the user in grasping the divider, and easier stacking of the containers. The bottom of the container wall 210 is folded around and bonded to the vertical portion 223 of the bottom wall 222, forming the bottom edge 220 of the container 1.

Figure 18:
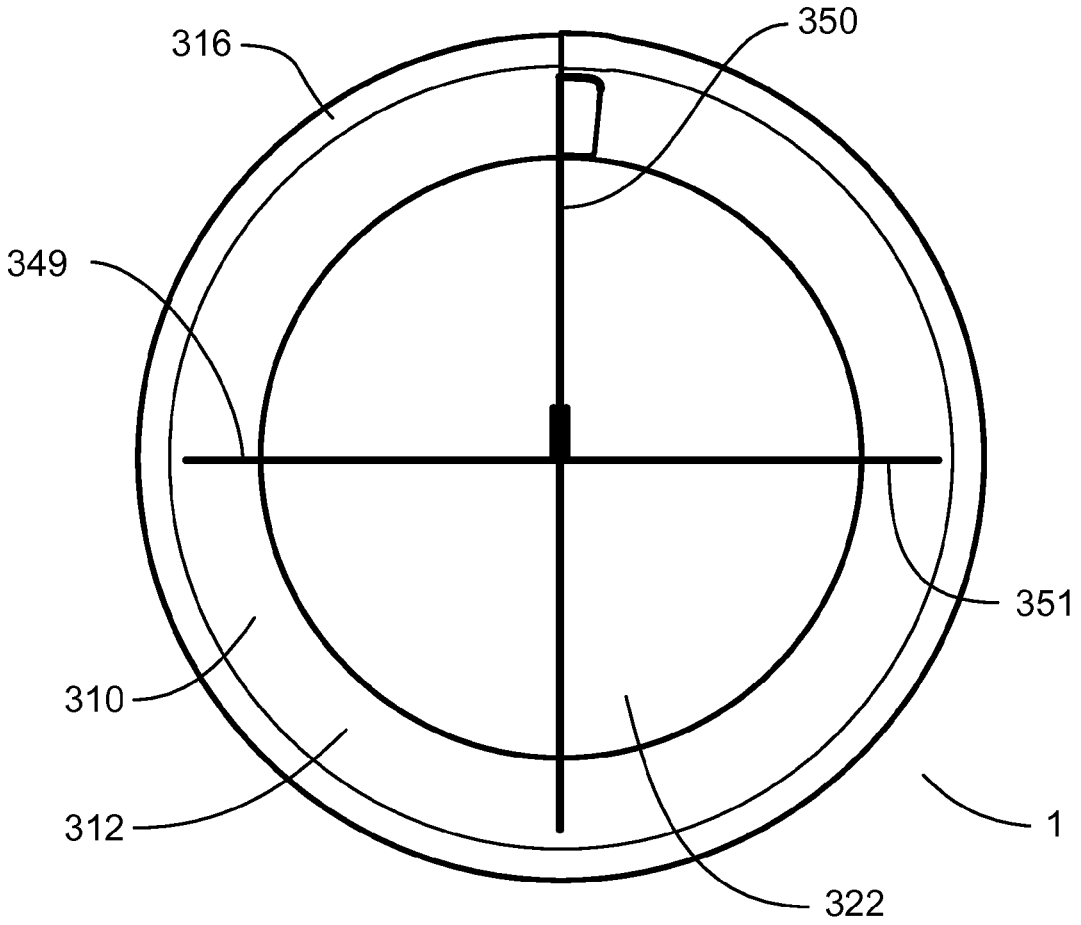
FIG. 18 is a top view of a fourth embodiment of the invention having a third divider attached to the first divider.

FIG. 18 is a top view of a fourth embodiment of the invention having a third 349 divider attached to the first divider 350 in addition to a second divider 351 attached to the first divider 350. This additional divider 349 allows the contents to be divided into four parts. The attachment of the second 351 and third dividers 349 to the first divider allows for simplified modular construction enabling the dividers 349, 350, 351 to be attached to one another prior to being attached to the container 1.

Figure 19:
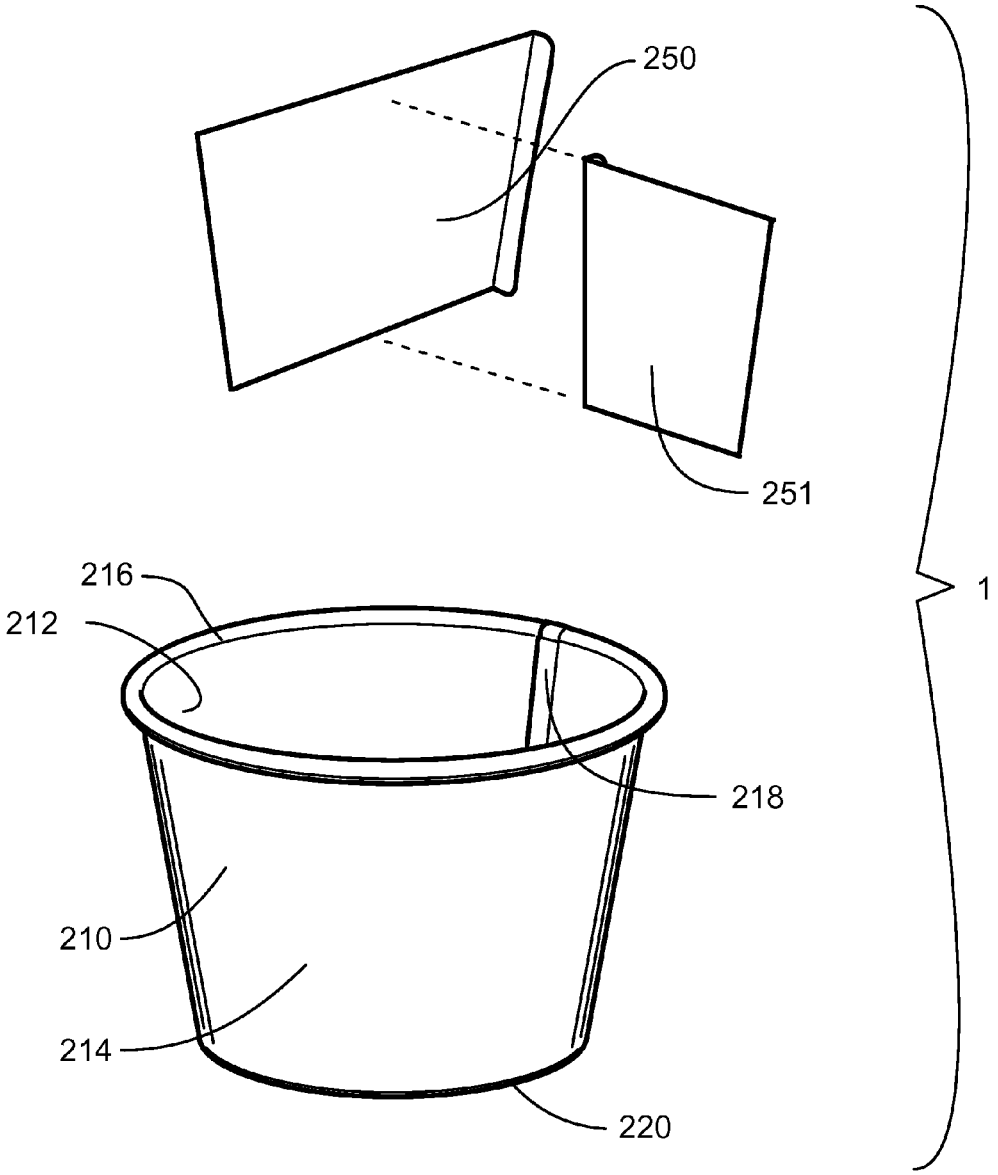
FIG. 19 is an exploded perspective view of the third embodiment of the invention showing the dividers separate from the container.

FIG. 19 is an exploded perspective view of the third embodiment of the invention showing the dividers 250, 251 separate from the container wall 210. The dividers 250, 251 are joined to one another, and the first divider 250 is joined to the interior surface 212 of the container wall 210 at a seam 218. The attachment of the divider simplifies the assembly process by the user.

Figure 20:
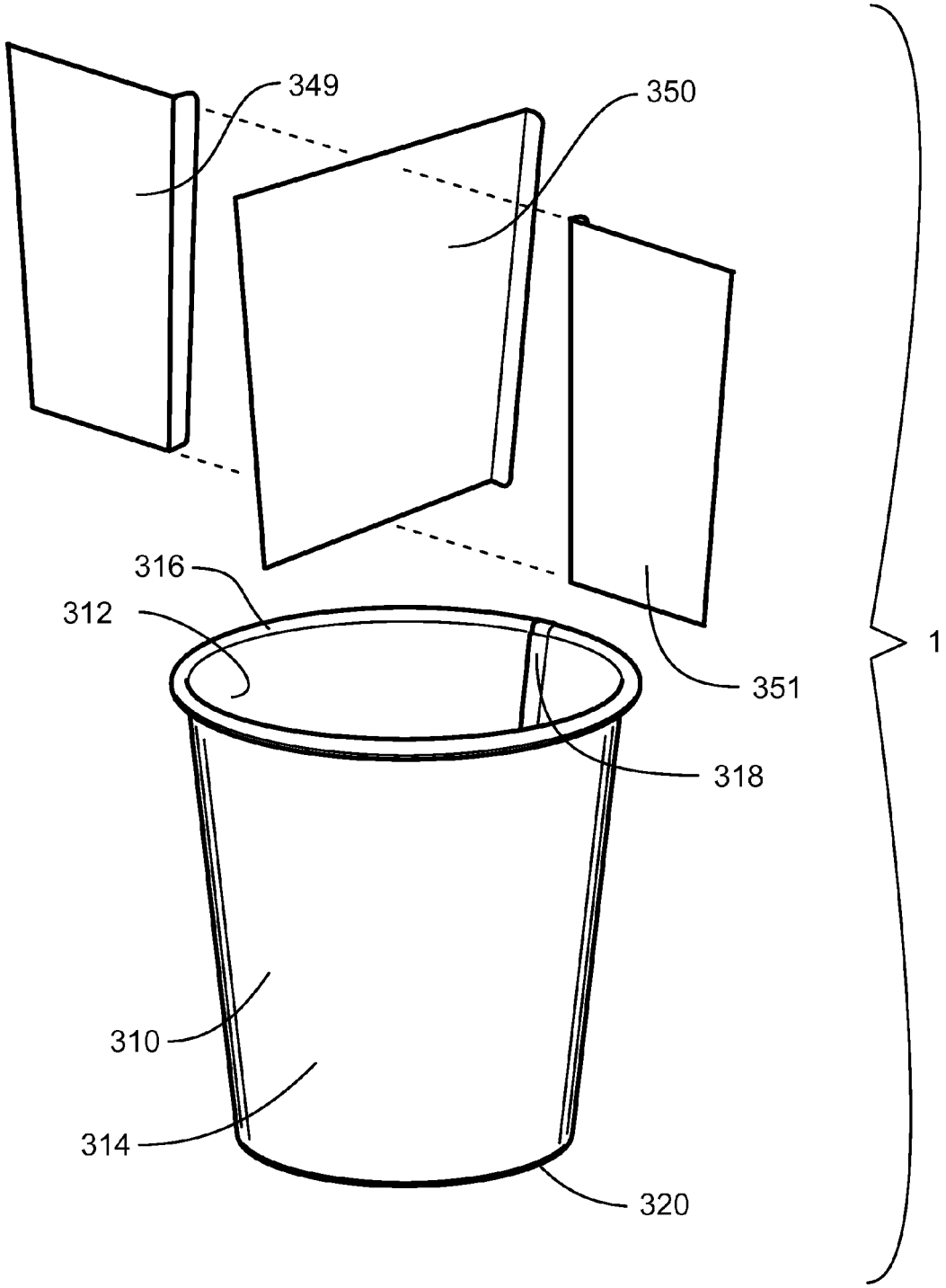
FIG. 20 is and exploded perspective view of the fourth embodiment of the invention.

FIG. 20 is an exploded perspective view of the fourth embodiment of the invention. A container wall 310 having an outer surface 314, an inner surface 312, a rolled opt edge 316, an attachment seam 318, and a bottom edge 321 (as shown in FIG. 13, for example) is provided for attachment to dividers 349, 350, 351. The second divider 351 and the third divider 349 are attached to the first divider 350 allowing the user to select one or more dividers for the desired number of partitions, or none at all, for an un-partitioned container. The dividers may be attached, in the case of paper containers, by the same means used to bond the seam of the container, such as by welding, glue or polyethylene bonding.

Figure 21:
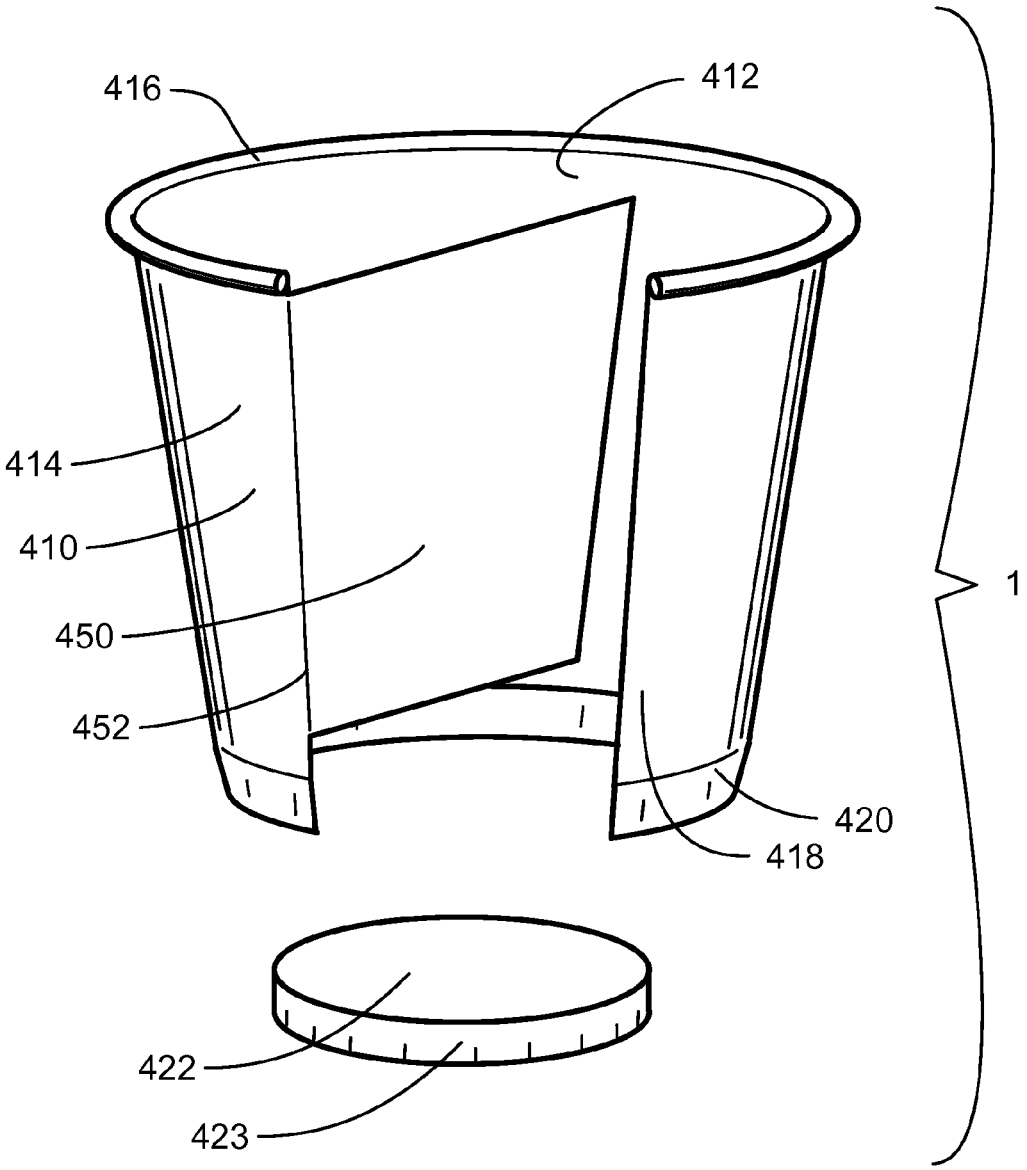
FIG. 21 is and exploded perspective view of a fifth embodiment of the invention.

FIG. 21 is an exploded perspective view of a fifth embodiment where a portion of the outer wall 410 forms the divider 450. Here the divider, cut shorter than the outer wall 410, is bent at a hinge line 452, but is otherwise continuous with the outer wall 410. The outer surface 414 and inner surface 412 are joined at a seam 418 adjacent to the hinge line 452. The divider 450 extends nearly the height of the interior of the container, or cup, from the top, or inner surface, of the bottom wall 422 to the top edge 416. As with the other embodiments, the bottom wall 422 is crimped to the outer wall 420 around the vertical portion 423 of the bottom wall. This embodiment saves the additional step of bonding a separate divider piece to the interior surface of the container.

What is claimed is:

1. A stackable container having a selectable divider, said container comprising:

a vertical container wall, said vertical container wall having an outer surface, an inner surface, a top edge, and a bottom edge, said vertical container wall having a horizontal circumference, said horizontal circumference larger at said top edge than at said bottom edge;

a bottom container wall, said bottom container wall having a horizontal portion and a vertical portion, said horizontal portion having an inner surface and an outer surface;

a first divider, said first divider having a front divider surface, a back divider surface, a top divider edge, a bottom divider edge, a first vertical divider edge and a second vertical divider edge; wherein said first divider is fixably attached to said vertical container wall at said first vertical divider edge to form a live hinge and is deployable within said container to provide a partition therein; and a second divider, having a front divider surface, a back divider surface, a top divider edge, a bottom divider edge, a first vertical edge and a second vertical edge;

wherein said second divider is fixably attached to said first divider to form a live hinge and is deployable therefrom and within said container to provide a second partition therein;

wherein said container may provide one, two, or three partitioned areas for contents placed therein through selected deployment of said first and second dividers.

2. The stackable container of claim 1 further comprising:

a vertical container wall first vertical edge;

a vertical container wall second vertical edge;

a vertical container wall seam;

wherein said vertical container wall first vertical edge is joined to said vertical container wall outer surface and said second vertical container wall second vertical edge forms said second vertical divider edge, wherein said first divider is formed from a portion of said vertical container wall from said vertical container wall seam to said vertical container wall second vertical edge.

3. The stackable container of claim 1 wherein said container is constructed from paper.

4. The stackable container of claim 1 further comprising:

a third divider having a front divider surface, a back divider surface, a top divider edge, a bottom divider edge, a first vertical edge and a second vertical edge;

wherein said third divider is attached to said first divider and is deployable therefrom and within said container to provide a third partition therein;

wherein said container may provide one, two, three, or four partitioned areas for contents placed therein through selected deployment of said first, second, and third dividers.

5. The stackable container of claim 1 wherein said first divider has a height extending from said top divider edge to said bottom divider edge, said bottom divider edge adjacent to said bottom wall when said divider is in a deployed position, said height being such that said divider top edge does not extend beyond said top edge of said container wall when said divider is folded against said container wall.

6. The stackable container of claim 1 wherein said first divider has a height extending from said top divider edge to said bottom divider edge, said bottom divider edge adjacent to said bottom wall when said divider is in a deployed position, said height being such that said divider top edge extends beyond said top edge of said container wall when said divider is folded against said container wall.

7. The stackable container of claim 1 wherein said container is a cup.

8. A stackable container having a selectable divider, said container comprising:

a vertical container wall, said vertical container wall having an outer surface, an inner surface, a top edge, and a bottom edge, said vertical container wall having a horizontal circumference, said horizontal circumference larger at said top edge than at said bottom edge;

a bottom container wall, said bottom container wall having a horizontal portion and a vertical portion, said horizontal portion having an inner surface and an outer surface;

a first divider, said first divider having a divider wall portion and a divider tab portion, a front divider surface, a back divider surface, a top divider edge, a bottom divider edge, a left divider edge and a right divider edge, and a divider hinge, said divider hinge dividing said divider wall portion from said divider tab portion;

wherein said first divider tab portion is bonded to said vertical container wall inner surface and is deployable within said container to provide a partition therein; and a second divider, having a front divider surface, a back divider surface, a top divider edge, a bottom divider edge, a first vertical edge and a second vertical edge;

wherein said second divider is fixably attached to said first divider to form a live hinge and is deployable therefrom and within said container to provide a second partition therein;

wherein said container may provide one, two, or three partitioned areas for contents placed therein through selected deployment of said first and second dividers.

9. The container of claim 8 wherein a seam is formed by the overlapping of a first vertical edge of said vertical container wall and a second vertical edge of said vertical container wall, said first divider tab portion is bonded to said seam on said vertical container wall inner surface.

10. The stackable container of claim 8 further comprising:

a third divider having a front divider surface, a back divider surface, a top divider edge, a bottom divider edge, a first vertical edge and a second vertical edge;

wherein said third divider is attached to said first divider and is deployable therefrom and within said container to provide a third partition therein;

wherein said container may provide one, two, three, or four partitioned areas for contents placed therein through selected deployment of said first, second, and third dividers.

11. The stackable container of claim 8 wherein said first divider has a height extending from said top divider edge to said bottom divider edge, said bottom divider edge adjacent to said bottom wall when said divider is in a deployed position, said height being such that said divider top edge does not extend beyond said top edge of said container wall when said divider is folded against said container wall.

12. The stackable container of claim 8 wherein said first divider has a height extending from said top divider edge to said bottom divider edge, said bottom divider edge adjacent to said bottom wall when said divider is in a deployed position, said height being such that said divider top edge extends beyond said top edge of said container wall when said divider is folded against said container wall.

13. The stackable container of claim 8 wherein said container is a cup.

14. A stackable frozen dessert cup container having a selectable divider, said container comprising:

a vertical container wall, said vertical container wall having an outer surface, an inner surface, a first vertical edge, a second vertical edge, a top edge, and a bottom edge, said first vertical edge overlapping said second vertical edge to form a vertical seam, said vertical container wall having a horizontal circumference, said horizontal circumference larger at said top edge than at said bottom edge, said vertical container wall having a maximum diameter measured across said top edge of and a height measured from said bottom edge to said top edge, said maximum diameter larger than said height;

a bottom container wall, said bottom container wall having a horizontal portion and a vertical portion, said horizontal portion having an inner surface and an outer surface, said horizontal portion bonded to the bottom portion of said vertical container wall;

a first divider, said first divider having a front divider surface, a back divider surface, a top divider edge, a bottom divider edge, a first vertical divider edge and a second vertical divider edge;

wherein said first divider is bonded to said vertical container wall inner surface to form a live hinge and is deployable within said container to provide a partition therein; and a second divider, having a front divider surface, a back divider surface, a top divider edge, a bottom divider edge, a first vertical edge and a second vertical edge;

wherein said second divider is fixably attached to said first divider to form a live hinge and is deployable therefrom and within said container to provide a second partition therein;

wherein said container may provide one, two, or three partitioned areas for contents placed therein through selected deployment of said first and second dividers.

15. The container of claim 14 wherein said container is constructed from paper.

16. The stackable container of claim 14 further comprising:

a third divider having a front divider surface, a back divider surface, a top divider edge, a bottom divider edge, a first vertical edge and a second vertical edge;

wherein said third divider is attached to said first divider and is deployable therefrom and within said container to provide a third partition therein;

wherein said container may provide one, two, three, or four partitioned areas for contents placed therein through selected deployment of said first, second, and third dividers.

* * * * *